US005947754A

United States Patent [19]

Lin

[11] Patent Number: 5,947,754

[45] Date of Patent: Sep. 7, 1999

[54] ELECTRICAL CONNECTING TO A PRINTED CIRCUIT BOARD

[75] Inventor: Cheng-Te Lin, Taipei Hsien, Taiwan

[73] Assignee: Molex Incorproated, Lisle, Ill.

[21] Appl. No.: 09/078,243

[22] Filed: May 13, 1998

[30] Foreign Application Priority Data

May 16, 1997 [CN] China ..... 86207970

[51] Int. Cl.[6] ..... H01R 9/09

[52] U.S. Cl. ..... 439/79

[58] Field of Search ..... 439/79, 80

[56] References Cited

U.S. PATENT DOCUMENTS

| | | | |
|---|---|---|---|
| 4,186,633 | 2/1980 | Mosser, III | 439/79 |
| 4,789,346 | 12/1988 | Frantz | 439/80 |
| 4,842,528 | 6/1989 | Frantz | 439/80 |
| 4,842,554 | 6/1989 | Cosmos et al. | 439/609 |
| 4,908,335 | 3/1990 | Cosmos et al. | 439/79 |
| 4,995,819 | 2/1991 | Ohl | 439/79 |
| 5,037,330 | 8/1991 | Fulponi et al. | 439/607 |
| 5,080,596 | 1/1992 | Viselli et al. | 439/79 |
| 5,192,228 | 3/1993 | Collins et al. | 439/567 |

*Primary Examiner*—Neil Abrams
*Assistant Examiner*—J. F. Duverne
*Attorney, Agent, or Firm*—James C. Paschall

[57] ABSTRACT

An electrical connector includes a dielectric connector body which is formed with vertically aligned upper and lower terminal holes. A tail guiding part projects rearwardly from a rear side of the connector body adjacent to a bottom side thereof and is formed with a tail guiding slot for passage of the downwardly extending tail portions of upper and lower terminals which are mounted in the upper and lower terminal holes, respectively. The tail guiding part has a pair of vertically stepped guide walls that confine a narrow and a wide section in the tail guiding slot and that provide shoulder faces between the two sections. The tail portion of the upper terminal has an enlarged part to contact against the shoulder faces, thereby preventing the tail portion of the upper terminal from moving toward the tail portion of the lower terminal. A portion of the tail guiding part is upset to form projections that extend into the wide section of the tail guiding slot to clamp the tail portion of the upper terminal against the shoulder faces.

18 Claims, 6 Drawing Sheets

ELECTRICAL CONNECTING TO A PRINTED CIRCUIT BOARD

FIELD OF THE INVENTION

This invention relates to an electrical connector, particularly to an electrical connector having a plurality of terminals with tails bent downwardly to extend into holes provided in a circuit board.

BACKGROUND OF THE INVENTION

Referring to FIGS. 1 and 2, a conventional electrical connector of the above-described type is shown to include a dielectric connector body 10 with a front terminal mating portion 100 for connecting with a plug (not shown). Four terminal holes 102, 102' are formed in the dielectric connector body 10 and extend from the front terminal mating portion 100 to a rear side 101 of the dielectric connector body 10. The bottom side of the connector body 10 has a rearwardly projecting tail guiding part 11 which is provided with two tail guiding slots 111. A pair of terminals 12 are respectively inserted into lower terminal holes 102 with their terminal tails 121 bent downward and passing through the tail guiding slots 111 for extension into holes of a printed circuit board. Another pair of terminals 12' which are inserted into upper terminal holes 102' also have their tails 121' passing through the tail guiding slots 111 for extension into the printed circuit board.

In the above-described electrical connector, each terminal tail 121' is longer than and extends downward behind the corresponding terminal tail 121 in the same tail guiding slot 111. Although each terminal tail 121 is guided by a portion 112 of the wall confining the corresponding tail guiding slot 111, it is not well-isolated from the adjacent terminal tail 121' since there is no positioning means in the tail guiding slot 111 for preventing the terminal tail 121' from deviating or displacing toward the terminal tail 121. Consequently, the rear terminal tails 121' are prone to deflect and touch the front terminal tails 121, thereby resulting in difficulty when fixing the terminal tails 121, 121' to the circuit board, increasing the risk of short-circuiting, and reducing the quality of transmitted signals.

SUMMARY OF THE INVENTION

An object of the invention is to provide an electrical connector of the above-mentioned type with an improved terminal tail guiding slot in which tail portions of terminals can be isolated from one another and can be effectively prevented from positional deviation.

According to an embodiment of the present invention, an electrical connector includes a dielectric connector body which is formed with vertically aligned upper and lower terminals holes that extend from a front side to a rear side of the connector body. The dielectric connector body further has a tail guiding part which projects rearwardly from the rear side of the connector body adjacent to a bottom side thereof and which is formed with a tail guiding slot. The electrical connector further includes upper and lower terminals mounted in the upper and lower terminal holes, respectively. The upper and lower terminals have tail portions which extend outwardly of the upper and lower terminal holes and then downwardly through the tail guiding slot. The tail portion of the upper terminal extends downward in the tail guiding slot behind the tail portion of the lower terminal.

The electrical connector is characterized in that the tail guiding part comprises first and second vertically stepped tiers respectively defining first and second horizontally offset faces. The tail guiding slot includes a wide slot extending from the first face through the first tier to a wide face and a narrow slot extending from the wide face through the second tier to a narrow face. The tail portion of the lower terminal extends through the tail guiding slot adjacent to the narrow face, and the tail portion of the upper terminal extends through the tail guiding slot adjacent to the wide face.

The tail guiding slot comprises a pair of substantially vertical opposing stepped guide walls defining a narrow section to receive the tail portion of the lower terminal and a wide section to receive the tail portion of the upper terminal. The guide walls provide shoulder faces that extend between the narrow section and the wide section in the first tier to define the wide face. The tail portion of the upper terminal has an enlarged portion for abutting against the shoulder faces to prevent the tail portion of the upper terminal from moving into the narrow section.

The first tier further comprises a projection that extends inwardly from the guide walls rearwardly of the tail portion of the upper terminal to clamp the tail portion of the upper terminal against the shoulder faces. Moreover, the second tier also comprises a projection that extends inwardly from the guide walls rearwardly of the tail portion of the lower terminal to clamp the tail portion of the lower terminal against the narrow face.

Other objects and advantages of the invention will be apparent from the following detailed description with reference to the accompanying drawings.

DETAILED DESCRIPTION OF THE PREFERRED EMBODIMENT

Figure 2:
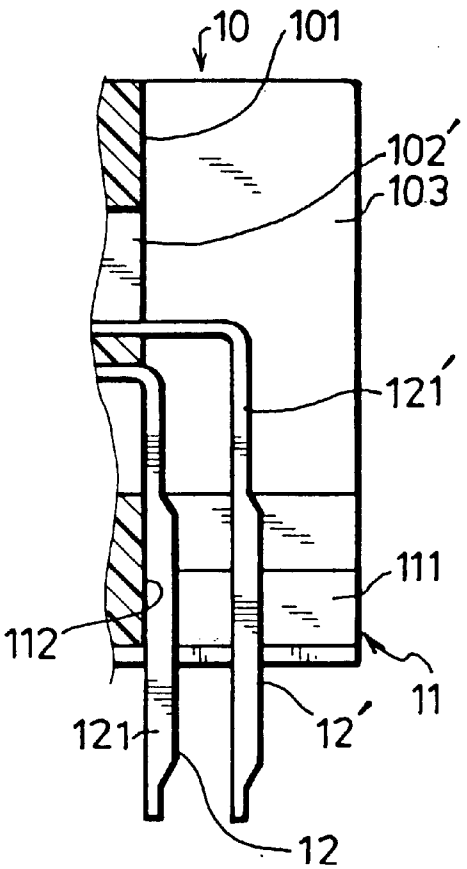
FIG.2 (PRIOR ART)
FIGS. 1 and 2 illustrate a conventional electrical connector.
Figure 1:
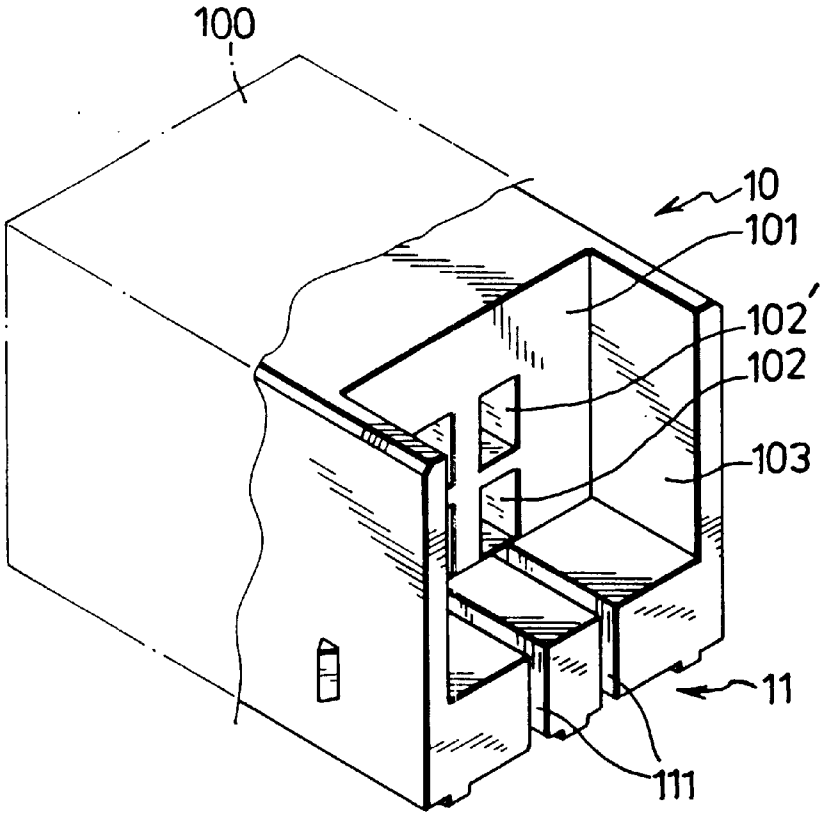
FIG.1 (PRIOR ART)
Figure 3:
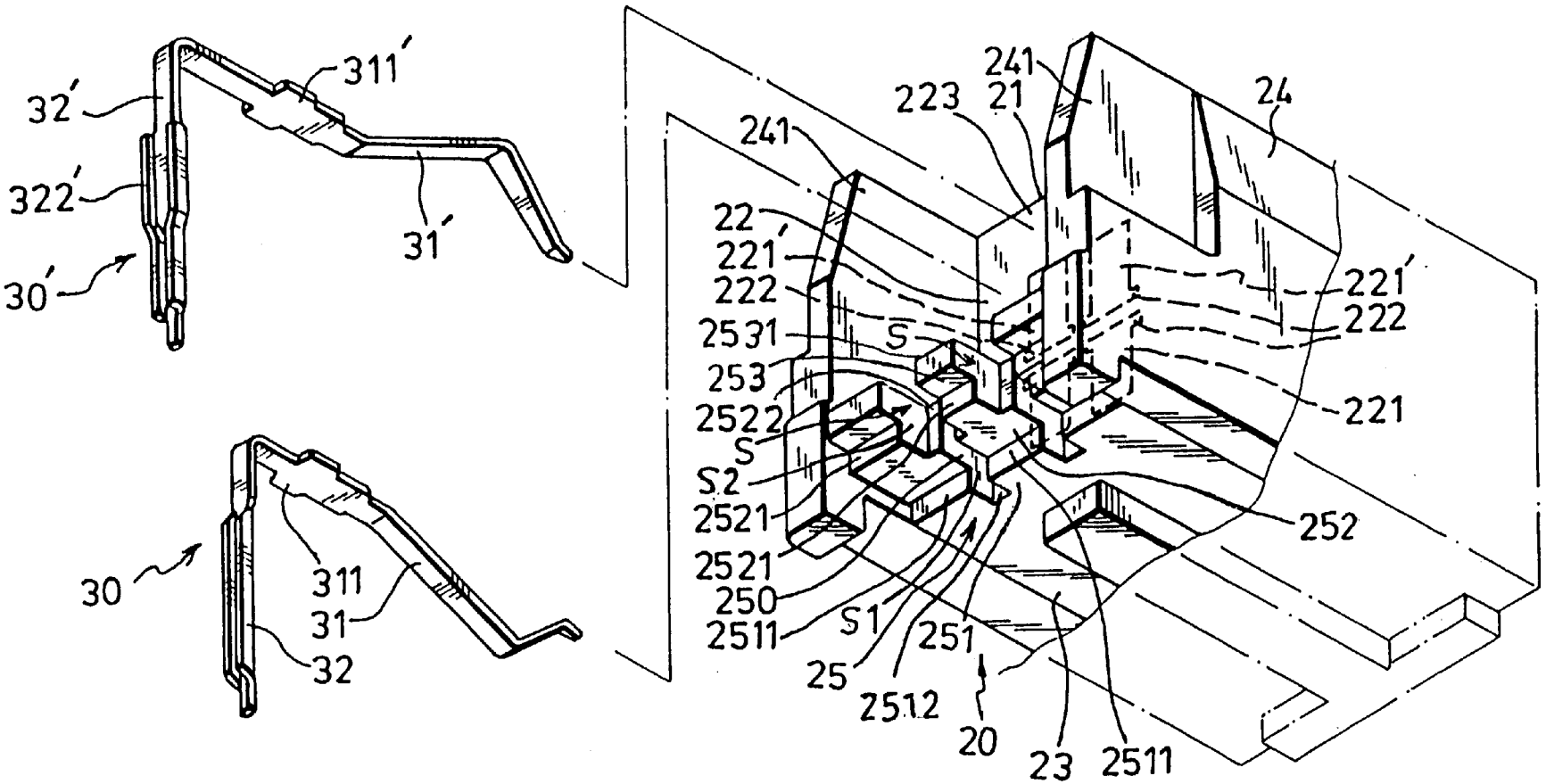
FIG. 3 is an exploded view of an electrical connector embodying the present invention.
Figure 5:
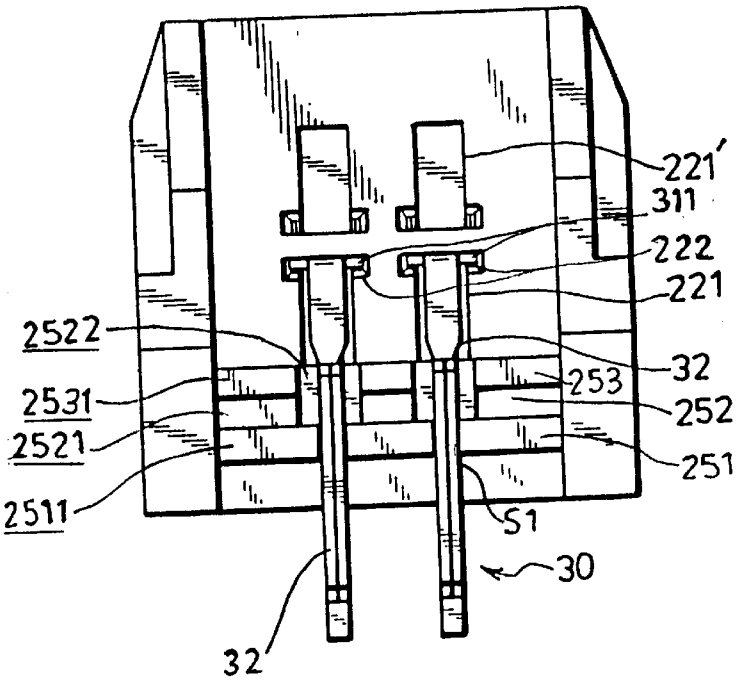
FIG. 5 is a rear view of the electrical connector of the invention of FIG. 3 with the upper terminal thereof being removed.
Figure 4:
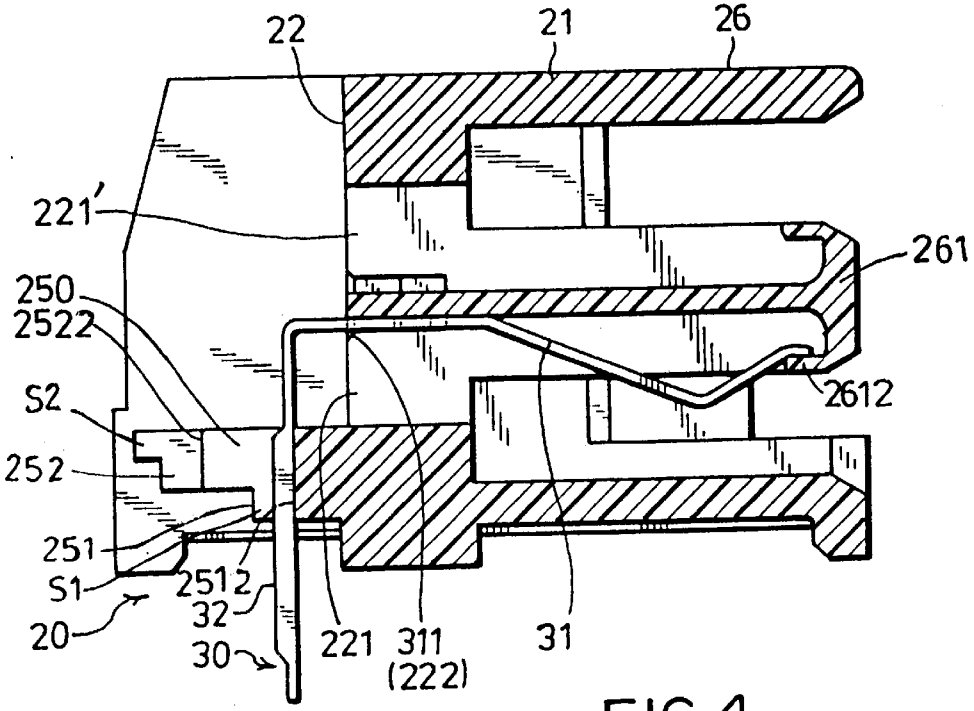
FIG. 4 is a sectional view of the electrical connector of the invention of FIG. 3 with the upper terminal thereof being removed.
Figure 8:
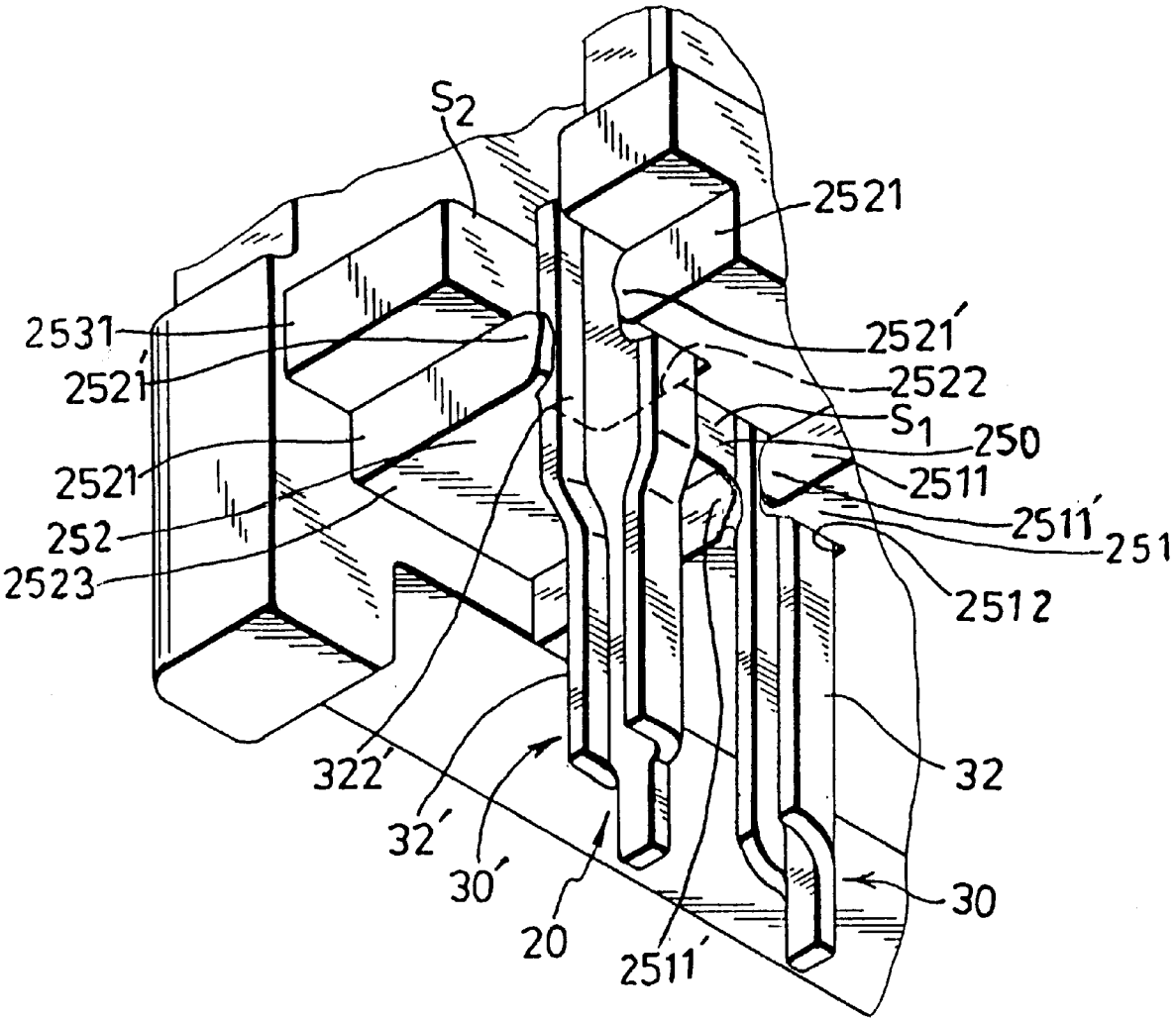
FIG. 8 is an enlarged perspective view showing a portion of the electric connector of FIG. 3.
Figure 9:
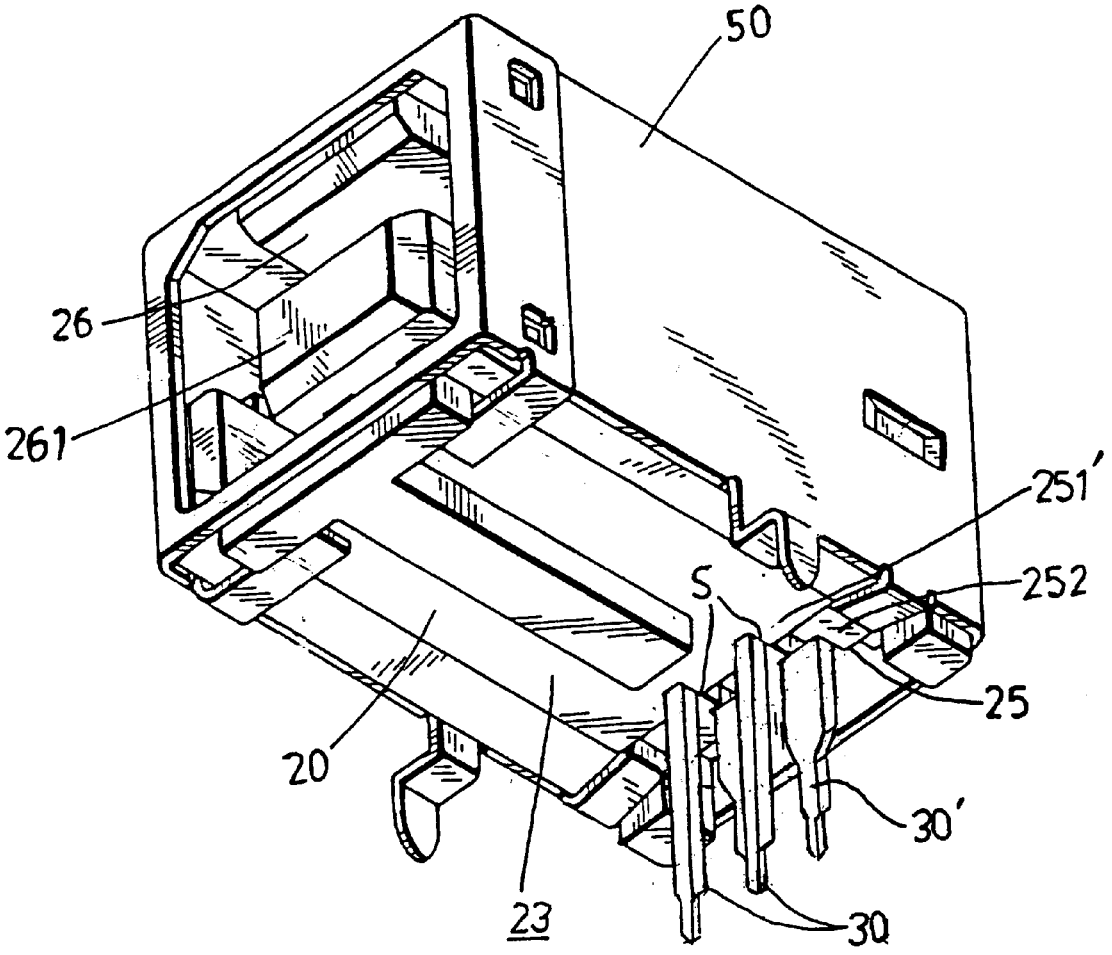
FIG. 9 is a perspective view of the electrical connector of the invention with a shield.

Referring to FIGS. 3, 4 and 5, an electrical connector embodying the present invention is shown to comprise a dielectric connector body 20 provided with four terminals 30, 30'. The connector body 20 is a rectangular body which has a top 21, a rear side 22, a bottom 23 and two opposing sides 24. As shown in FIG. 9, the dielectric connector body 20 is preferably encased in a conductive shield 50. However, for illustrative purposes, the electrical connector of the present invention will be described with reference to FIGS. 3–8 without a shield. A terminal mating part 26 is formed with a terminal projection 261 opposite to the rear side 22 of the connector body 20 for connection with a plug (not shown). Two horizontal rows of terminal cavities 221' and 221 are aligned vertically in the connector body 20 and extend from the terminal projection 261 of the front terminal mating part 26 to the rear side 22 of the connector body 20. Each terminal cavity 221', 221 has an enlarged section 222 to position the corresponding terminal 30 or 30'. A space 223 is confined by the rear side 22 and two walls 241 which project rearward from the two sides 24 of the connector body 20.

A tail guiding part 25 projects rearward from the bottom 23 of the connector body 20. The tail guiding part 25 includes a lower tier 251 continuous with the bottom 23, a middle tier 252 and an upper tier 253 that are vertically and horizontally offset from each other to provide a lower face 2511, a middle face 2521 and an upper face 2531, respectively. The lower face 2511 is horizontally closest to the rear side 22, the upper face 2531 is horizontally farthest from the rear side 22 and the middle face 2521 is horizontally positioned between the upper face 2531 and the lower face 2511. The tail guiding part 25 is provided with two tail guiding slots S. Each tail guiding slot S is confined by a front guide wall 2512 and two opposing vertical stepped walls 250 so that the tail guiding slot S has a narrow section S1 and a wide section S2 (as best shown in FIG. 8). Each stepped wall 250 defines a shoulder face 2522. The wide section S2 of the slot S extends through the upper face 2531 of upper tier 253 and the middle face 2521 of middle tier 252 to shoulder face 2522. The narrow section S1 of the slot S extends from the shoulder face 2522 of middle tier 252 and the lower face 2511 of the lower tier to front guide wall 2512. The wide section S2 of the slot S does not extend through the lower tier 251.

As shown in FIGS. 4 and 5, each terminal 30 has a resilient bent part 31 which is inserted into a corresponding lower terminal cavity 221 and engages an engaging recess 2612 formed in the terminal projection 261 of the connector body 20. Each terminal 30 further has an enlarged retention portion 311 positioned in the enlarged section 222 of the corresponding terminal cavity 221, and a tail portion 32 which is bent downward and outwardly of the terminal holes 221. The tail portion 32 passes through the corresponding tail guiding slot S along the front guide wall 2512 in the narrow section S1.

Figure 7:
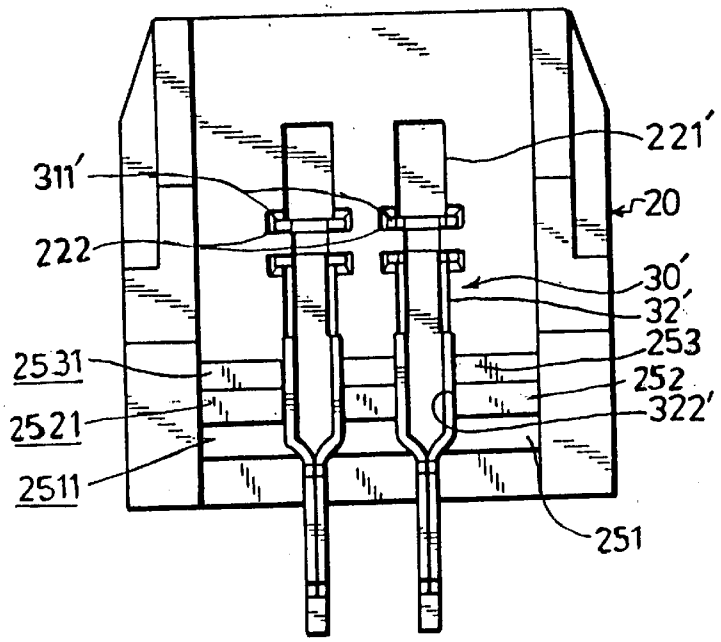
FIG. 7 is a rear view of the electrical connector of FIG. 3.
Figure 6:
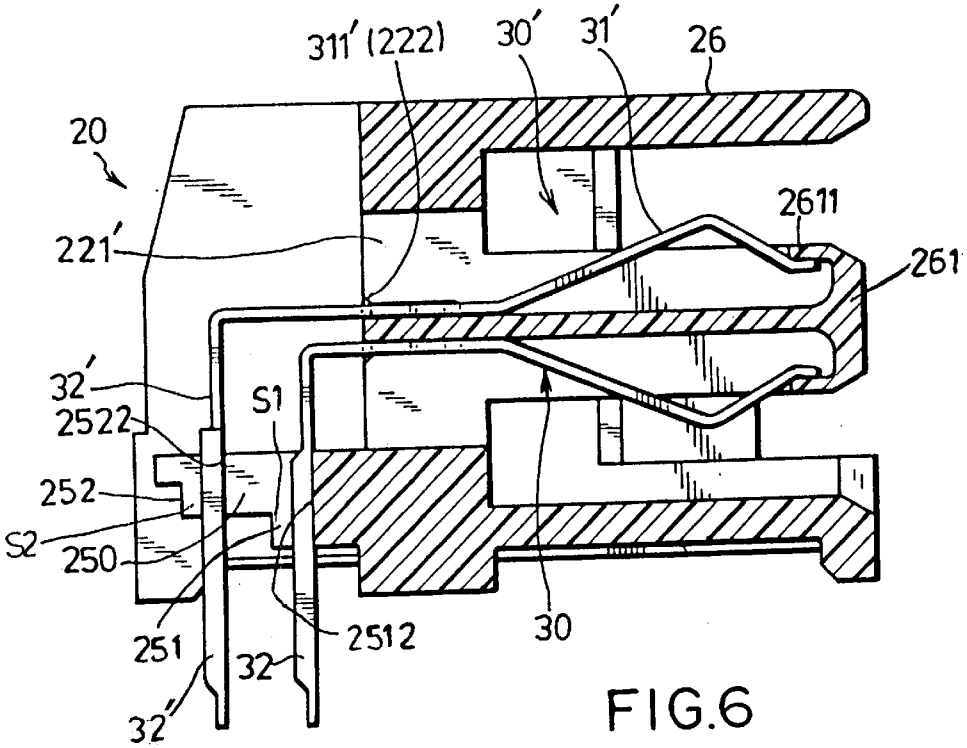
FIG. 6 is a sectional view of the electrical connector of FIG. 3.

As shown in FIGS. 6 and 7, each terminal 30' has a resilient bent part 31' which is inserted into one of the upper terminal cavities 221' and which engages an engaging recess 2611 formed in the terminal projection 261 at the front mating part 26 of the connector body 20. An enlarged retention portion 311' of each terminal 30' is positioned in the enlarged section 222 of the terminal cavity 221', while a tail portion 32' thereof is bent downward to pass through the wide section S2 of the corresponding tail guiding slot S. Each tail portion 32' extends downward behind the adjacent tail portion 32 in the same tail guiding slot S, and has an enlarged part 322' (as best shown in FIGS. 3 and 7) which is placed in abutment with the corresponding first shoulder face 2522. The tail portion 32' is therefore isolated from or prevented from moving toward the adjacent tail portion 32.

As best shown in FIG. 8, the middle face 2521 is horizontally offset forwardly from upper face 2531. Hence, the middle tier 252 has a smaller thickness than if the upper tier 253 and the middle tier 252 were combined to form one tier with one face. Moreover, the depth of the wide section S2 of the slot S from the shoulder face 2522 to the middle face 2521 is greater than the front-to-rear thickness of the terminal 30' at the enlarged part 322'. Accordingly, the middle face 2521 provides vertical surfaces at both sides of the wide section S2 of the tail guiding slot S rearwardly of the tail portion 32'. The middle tier 252 is fused and upset, such as by staking, at the middle face 2521 to form a pair of projections 2521' extending inwardly of guide walls 250 into the wide section S2 rearwardly of the tail portion 32', thereby clamping the tail portion 32' against the first shoulder face 2522. Positional deviation of the tail portion 32' is therefore effectively prevented.

The lower face 2511 is horizontally offset forwardly from middle face 2521. The depth of the narrow section S1 of the slot S from the front guide wall 2512 to the lower face 2511 is greater than the front-to-rear thickness of the lower terminal 30 at the tail portion 32. Accordingly, the lower face 2511 provides vertical surfaces at both sides of the narrow section S1 rearwardly of the tail portion 32 of the lower terminal 30. The lower tier 251 is preferably fused and upset, such as by staking, at lower face 2511 to form projections 2511' extending inwardly of guide walls 250, so as to clamp the tail portion 32 against the front guide wall 2512 and effectively prevent positional deviation.

With the inventions thus explained, it is apparent that various modifications and variations can be made without departing from the spirit of the invention. It is therefore intended that the invention be limited only as indicated in the pending claims.

I claim:

1. An electrical connector comprising a dielectric connector body having a front side, a rear side, a top side, and a bottom side, said connector body being formed with an upper terminal cavity and a lower terminal cavity, said upper and lower terminal cavities extending from said front side to said rear side and being substantially aligned vertically, said dielectric connector body further having a tail guiding part that projects rearwardly from said rear side adjacent to said bottom side and which is formed with a tail guiding slot, and an upper terminal and a lower terminal mounted in said upper and lower terminal cavities, respectively, said upper and lower terminals having tail portions which extend outwardly of said upper and lower terminal cavities and downwardly through said tail guiding slot, said tail portion of said upper terminal extending downward in said tail guiding slot behind said tail portion of said lower terminal wherein said tail guiding part comprise first and second vertically stepped tiers respectively defining first and second horizontally offset faces, and said tail guiding slot including a wide slot extending from said first face through the first tier to a wide face and a narrow slot extending from said wide face through said second tier to a narrow face, said tail portion of said lower terminal extending through said tail guiding slot adjacent to said narrow face and said tail portion of said upper terminal extending through said tail guiding slot adjacent to said wide face.

2. The electrical connector according to claim 1, wherein said tail guiding slot comprises a pair of substantially vertical opposing stepped guide walls defining a narrow section to receive said tail portion of said lower terminal, and a wide section to receive said tail portion of said upper terminal, said guide walls providing shoulder faces that extend between said narrow section and said wide section in said first tier to define said wide face, said tail portion of said upper terminal having an enlarged portion for abutting against said shoulder faces to prevent said tail portion of said upper terminal from moving into said narrow section.

3. The electrical connector according to claim 2, wherein said first tier further comprises at least one projection that extends from the guide walls rearwardly of said tail portion of said upper terminal to clamp said tail portion of said upper terminal against said shoulder faces.

4. The electrical connector according to claim 3, wherein said tail guiding part includes a third tier vertically stepped from said first tier defining a third face horizontally offset from said first tier and said wide section extending from said third face to said shoulder faces.

5. The electrical connector according to claim 3 wherein said projection extending from said first face being formed by upsetting said first face.

6. The connector of claim 1 wherein said narrow face is disposed more forwardly than said wide face with respect to said front side.

7. The connector of claim 1 wherein said lower terminal cavity is disposed closer to said tail guiding part than said upper terminal cavity.

8. The connector of claim 1 wherein said first tier is above said second tier.

9. The connector of claim 1 wherein said wide face is disposed more rearwardly than said second face of said second tier with respect to said front side.

10. The connector of claim 1 wherein said narrow slot extends through said wide face.

11. The connector of claim 1 wherein said second tier further comprises at least one projection that extends from said guide walls rearwardly of said tail portion of said lower terminal to clamp said tail portion of said lower terminal against said narrow face.

12. The connector of claim 3 wherein said first face of said first tier is upset to clamp the upper terminal in said wide slot.

13. The connector of claim 11 wherein said second face of said second tier is upset to clamp the lower terminal in said narrow slot.

14. The connector of claim 1 wherein the dielectric body is encased in a conductive shield.

15. A shielded electrical connector comprising:

a dielectric connector body having a front side, a rear side, a top side, and a bottom side, said connector body being formed with a two pairs of vertically aligned upper and lower terminal cavities, each terminal cavity extending from said front side to said rear side, said dielectric connector body further having a tail guiding part that projects rearwardly from said rear side adjacent to said bottom side, the tail guiding part including first and second vertically stepped tiers respectively defining first and second horizontally offset faces and two tail guiding slots each slot being aligned with a respective pair of vertically aligned upper and lower terminal cavities, each slot comprises a wide section extending from said first face through said first tier to a wide face and a narrow section extending from said wide face through said second tier to a narrow face, a pair of an upper terminal and a lower terminal mounted in a respective cavity of each aligned pair of upper and lower terminal cavities, each terminal in said pair of said upper and lower terminals having tail portions which extend outwardly of a respective one of said terminal cavities and downwardly through a respective one of said tail guiding slots, a tail portion of said lower terminals in each pair of upper and lower terminals extending through said narrow section of a respective one of said tail guiding slots adjacent to said narrow face and a tail portion of said upper terminals in each pair of upper and lower terminals extending through said wide section of a respective one of said tail guiding slot adjacent to said wide face behind said tail portion of said lower terminal in said respective pair of upper and lower terminals.

16. The shielded electrical connector according to claim 15, wherein said tail guiding slot comprises a pair of substantially vertical opposing stepped guide walls defining said narrow section and said wide section and providing shoulder faces that extend between said narrow section and said wide section in said first tier to define said wide face.

17. The shielded electrical connector according to claim 16 wherein said tail portion of said upper terminal has an enlarged portion for abutting against said shoulder faces to prevent said tail portion of said upper terminal from moving into said narrow section.

18. A shielded electrical connector comprising:

a dielectric connector body having a front side, a rear side, a top side, and a bottom side, said connector body being formed with vertically aligned upper and lower terminal cavities, each terminal cavity extending from said front side to said rear side, said dielectric connector body further having a tail guiding part that projects rearwardly from said rear side adjacent to said bottom side, the tail guiding part including first and second vertically stepped tiers respectively defining first and second horizontally offset faces and a tail guiding slot being aligned with said aligned upper and lower terminal cavities, the slot comprises a wide section extending from said first face through said first tier to a wide face and a narrow section extending from said wide face through said second tier to a narrow face and providing shoulder faces that extend between said narrow section and said wide section in said first tier to define said wide face;

an upper terminal and a lower terminal mounted in a respective cavity of the aligned pair of upper and lower terminal cavities, each terminal in said pair of said upper and lower terminals having tail portions which extend outwardly of a respective one of said terminal cavities and downwardly through said tail guiding slot, a tail portion of said lower terminal extending through said narrow section of said tail guiding slot adjacent to said narrow face and a tail portion of said upper terminal extending through said wide section of said tail guiding slot adjacent to said wide face behind said tail portion of said lower terminal, said tail portion of said upper terminal has an enlarged portion for abutting against said shoulder faces of said wide face to prevent said tail portion of said upper terminal from moving into said narrow section of said slot.

* * * * *